US006258207B1

(12) United States Patent
Pan

(10) Patent No.: US 6,258,207 B1
(45) Date of Patent: Jul. 10, 2001

(54) ALKALINE PEROXIDE MECHANICAL PULPING OF NON-WOODY SPECIES

(75) Inventor: George X. Pan, Ed monton (CA)

(73) Assignee: Alberta Research Council Inc., Edmonton (CA)

( * ) Notice: Subject to any disclaimer, the term of this patent is extended or adjusted under 35 U.S.C. 154(b) by 0 days.

(21) Appl. No.: 09/293,810

(22) Filed: Apr. 19, 1999

Related U.S. Application Data

(63) Continuation-in-part of application No. 09/061,941, filed on Apr. 17, 1998, now abandoned.

(51) Int. Cl.[7] ..... D21B 1/02; D21C 1/04; D21C 1/16

(52) U.S. Cl. ..... 162/27; 162/78; 162/79; 162/96; 162/97; 162/98; 162/99

(58) Field of Search ..... 162/55, 76, 77, 162/78, 80, 90, 91, 96, 97, 98, 99, 27

(56) References Cited

U.S. PATENT DOCUMENTS 4,016,029 * 4/1977 Samuelson ..... 162/31
4,849,053 7/1989 Gentile, Jr. et al. ..... 162/76
5,002,635 * 3/1991 Gentile, Jr. et al. ..... 162/76

FOREIGN PATENT DOCUMENTS 0 509 905 A1 4/1992 (EP) .
XP-002108506 1/1981 (GB) .
WO 97/22749 12/1995 (WO) .
WO 97/30208 2/1997 (WO) .

* cited by examiner

*Primary Examiner*—Dean T. Nguyen
(74) *Attorney, Agent, or Firm*—Freedman & Associates

(57) ABSTRACT

High-yield chemimechanical lignocellulosic pulp is produced from non-woody species by cutting and screening the non-woody species, soaking them in an acidic aqueous solution preferably containing a chelating agent, treating the washed non-woody species with an alkaline peroxide solution containing a second chelating agent, and mechanical refining. To further increase the bleaching efficiency the non-woody species are impregnated with ozone or peracetic acid. The resulting pulp has a relatively high brightness while the consumption of peroxide is reduced compared to prior art processes.

21 Claims, 5 Drawing Sheets

ALKALINE PEROXIDE MECHANICAL PULPING OF NON-WOODY SPECIES

This application is a Continuation-In-Part of U.S. patent application Ser. No. 09/061,941 filed Apr. 17, 1998 now abandoned Jan. 6, 2000.

FIELD OF THE INVENTION

This invention relates to the production of lignocellulosic pulp using non-woody species as raw material, and particularly of a chemimechanical lignocellulosic fibrous product suitable for papermaking.

BACKGROUND ART

There is growing interest in using non-woody species, such as wheat straw and hemp, for pulping and papermaking. Economically, these materials can find value-added utilization that would enhance the profitability of farm production.

As future worldwide fiber shortages are predicted, agricultural fibers are believed to be a sustainable fiber supply to potentially substitute wood fibers in certain paper applications. On the other hand, market forces and, perhaps, legislative requirements may stimulate the production of an "environmentally friendly" paper that contains agricultural fibers, as exemplified by the recent experience with recycled fibers.

The art of papermaking was originally developed using non-wood plant sources, including wheat straw, and the production of pulp and paper from wood is a relatively recent development. Pulping processes can be broadly divided into two large categories: chemical pulping and mechanical pulping. The chemical pulping involves using chemical reactions to solubilize lignin and produce individual fibers or pulp from lignocellulosic raw materials. Within the mechanical pulping, there are many processes which involve varying combinations of chemical, mechanical and thermal treatments to effect fiber separation, remove some lignin and other chemical components from the original fibers, or increase the brightness or papermaking strength of the resulting fibers.

One of the problems associated with the chemical pulping of straw is its heavy environmental impact because of a high silica content of the fibers, inherent in most agricultural residues, which makes conventional chemical recovery difficult. Alternatively, mechanical pulping seems to be suitable for cereal straws (wheat, oat, barley, rice), particularly wheat straw, since the latter is easy to disintegrate by mechanical action. Mechanical pulping generates a minimal volume of effluent, thus reducing the environmental impact.

Chemimechanical pulps (CMP) from wood are produced by processes in which roundwood or chips are treated with weak solutions of pulping chemicals such as sulfur dioxide, sodium sulfite, sodium bisulfite or sodium hydrosulfite, followed by mechanical defibration.

Alkaline peroxide mechanical pulping (APMP) is one of the processes to consider to produce bleachable pulp for printing grade papers using non-woody species, such as straw and hemp, as raw material. In U.S. Pat. Nos. 4,849,053 and 5,002,635, Gentile et al. propose that a wood pulp of improved quality is produced from chips using pretreatment with stabilizers and alkaline peroxide prior to refining. The APMP process is based on the incorporation of peroxide bleaching into chemical impregnation and refining stages in which bleaching action takes place not only to eliminate alkali darkening of wood chips but to brighten them to certain brightness levels as well. Therefore, it allows the production of a fully bleached pulp with no need to install a separate bleaching plant (Cort, C. J. and Bohn, W. L., "Alkaline Peroxide Mechanical Pulping of Hardwoods", Tappi J., 74(6): 79–84, 1991). Like sulfonation, carboxylation of lignin by alkaline peroxide results in easier fiber separation during refining and improved fiber bonding in papermaking. Due to its suitability for low-density hardwoods (Cort et al, supra), adaptation of the wood APMP process to straw and hemp appears obvious. The process is environmentally friendly, high-yielding, and uses non-sulfur pulping and chlorine-free bleaching. The alkaline peroxide impregnation stage of the APMP process is similar to conventional bleaching in many respects.

Various pulping and bleaching processes are described in the following patent literature: WO 96/25552 (Henricson et al.), U.S. Pat. No. 4,793,898, WO 94/006964 (Chang et al.), WO 86/05529 (Laamanen et al.), WO 94/17239 (Nilsson et al.), WO 94/29515 (Tibbling et al.) and U.S. Pat. No. 4,400,237.

U.S. Pat. No. 5,320,710 discloses a soft high strength tissue using long-low coarseness hesperaloe fibers. A significant challenge to the papermaker is to make tissues which are not only soft, absorbent and thick but also strong. Typically, softness, absorbency, and thickness are inversely related to strength. High strength specialty papers have been made using non-woody fibers usually termed hard or cordage fibers, such as sisal, abaca, hemp, flax and kenaf. As described in Mclaughlin and Schuck, Econ. Bot 45 (4), pp. 480–486, 1991, such fibers are commonly used for such products as currency paper, bank notes, tea bags, rope paper, filters, air cleaners and other products requiring scruff and tear resistance along with high endurance for folding.

U.S. Pat. No. 4,106,979 discloses a method for the preparation of paper pulps from dicotyledonous plants, such as kenaf and hemp. A dicotyledonous plant has two morphologically distinctive regions in its stem, the outer or bark fraction which contains the bast fibers and the inner or woody core fraction.

Hydrogen peroxide is a versatile and widely used bleaching agent in the pulp and paper industry. It can be used to increase the brightness of mechanical pulps and to delignify and brighten chemical pulps in a multi-stage bleaching sequence. It is generally accepted that hydroperoxide anion is the principal active species in peroxide bleaching systems. As its formation can be regulated by pH, the alkalinity of the bleach liquor should be high enough to ensure an adequate concentration of hydroperoxide anion.

On the other hand, hydrogen peroxide is unstable in alkaline conditions and readily decomposes. The decomposition is accelerated by increasing pH and temperature and the presence of certain transition metals, particularly iron, copper and manganese. This metal-catalyzed decomposition of hydrogen peroxide is generally considered undesirable in the bleaching operation since it leads to a loss of brightening capacity. Additionally, the decomposition products include molecular oxygen, hydroxyl radical ($HO^-$) and superoxide anion radical ($O_2^-$), and they may participate in degradation reactions of both lignin and carbohydrates and in chromophore-creating reactions.

In the hemp and wheat straw APMP process, it is critical to produce a pulp of high brightness without significant loss of pulp yield. To meet this requirement, one must fully utilize the brightening potential of hydrogen peroxide and minimize its nonfunctioning loss. As mentioned above, the decomposition of hydrogen peroxide under alkaline conditions is greatly influenced by the presence of certain inorganic compounds i.e. transition metal ions. Conversely, alkali-earth metals like magnesium and calcium, as well as silicon, are considered peroxide stabilizers. To control peroxide decomposition, a proper balance should be sought between these two categories of metals. While all these metals are either initially present in fiber raw materials or introduced as impurities from the bleaching chemicals, process water and equipment, removing or deactivating the transition metals is essential to minimizing the occurrence of catalytic peroxide decomposition. In practice, two approaches, commonly used together, are employed to achieve the pretreatment of pulp before bleaching and stabilization of bleach liquor. Chelation is an effective way to complex and wash out metals from pulp using chelating agents such as diethylene triaminepenta-acetic acid (DTPA) and ethylene diaminetetra-acetic acid (EDTA). See U.S. Pat. Nos. 4,849,053, 5,002,635 to Gentile et al. and U.S. Pat. No. 4,732,650. As a second approach, sodium silicate and magnesium salts have proven stabilizing effects and are in widespread use (Ali, T. et al, "The Roles of Silicate in Peroxide Brightening of Mechanical Pulp 1. The Effect of Alkalinity, pH, Pre-treatment with Chelating Agents and Consistency", J. Pulp Paper Sci., 12 (6): J166–J172 (1986), and Colodette, J. L. et al, "Factors Affecting Hydrogen Peroxide Stability in the Brightening of Mechanical and Chemimechanical Pulps. Part 111: Hydrogen Peroxide Stability in the Presence of Magnesium and Combinations of Stabilizers", J. Pulp Paper Sci., 15 (2): J45–J50 (1989).

In addition, chelating agents such as DTPA and diethylene triaminepentamethylene phosphonic acid (DTPMPA) are also used as organic stabilizers for bleach liquor stabilization (U.S. Pat. No. 4,732,650 and Kuczynski, K. et al, "DTPMPA: polyamino polyphosphonic acid and its use in Paper Processes, Part 1: The chemistry of Pulp Bleaching with DTPMPA and Its Impact on Fines Retention", Tappi J., 71(6):171–174 (1988)).

Hemp and straw fibers are difficult to bleach. At a given peroxide dosage, the achievable brightness level is much lower with straw fibers than with wood fibers. In order to produce hemp and straw pulps of high brightness at economical levels of peroxide charge, it is important to choose suitable stabilizing systems for peroxide bleaching liquors as well as appropriate bleaching conditions which should be suited to the characteristics of hemp and straw fibers. It is widely recognized that the chemistry and morphology of hemp and straw, for example wheat straw, is different from those of wood. Wheat straw has a substantially different metal profile than wood—a lower content of transition metals and a higher content of magnesium, silicon and calcium. Also, wheat straw contains appreciable amounts of low-molecular-weight lignin and hemicelluloses, which are easily solubilized in alkaline medium. As a result, alkaline peroxide solutions are capable of substantially dissolving lignins from wheat straw (U.S. Pat. Nos. 4,649,113 and 4,957,599).

The above factors make it difficult to use alkaline peroxide for brightening hemp and wheat straw to high levels while preserving pulp yield by limiting the dissolution of its components.

SUMMARY OF THE INVENTION

It is an object of the invention to provide a process for making lignocellulosic pulp from non-woody species specifically from straw, e.g. wheat straw, and hemp.

It is another object of the invention to provide such process including peroxide bleaching of such pulp to a relatively high brightness of the fibrous product, while minimizing the consumption of peroxide in the process.

The process according to the invention comprises the following steps:

a) pretreating the straw with an aqueous acidic solution at a pH of about 1 to about 7, at a temperature below about 80° C. for a time effective to render the non-woody species susceptible to subsequent bleaching with a loss of weight of the non-woody species below about 10 wt. %, the solution containing from 0 to about 1.5 wt. % of a chelating agent based on the dry weight of the original (raw) non-woody species, b) impregnating the non-woody species with an alkaline peroxide solution containing a chelating agent in an amount from about 0 to about 0.5 wt. % based on the dry weight of the original non-woody species, at a temperature and for a time effective to achieve a brightness of resulting product at least about 45% ISO, with the loss of weight of said product below about 25 wt. % based on an original weight of said non-woody species, and c) mechanically defibrating the impregnated non-woody species to produce pulp.

Preferably, the pH of said acidic solution is from about 2 to about 3.

The duration of the pretreating step is preferably from about 0.5 hours to about 2 hours, the higher temperature usually corresponding to a shorter duration.

In a preferable embodiment of the invention, the temperature of step a) is between about 50° C. and about 80° C., as a temperature higher than about 80° C. may have an adverse effect on the subsequent bleaching. The acidic solution preferably contains either acetic acid or sulfuric acid or both.

The chelating agent in step a) is preferably one or more compounds selected from the group consisting of diethylene triaminepenta-acetic acid, hydroxyethylethylenediaminetriacetic acid, nitriloacetic acid, sodium tripolyphosphate and diethylenetriaminepentamethylenephosphonic acid, and the concentration of the agent is preferably from about 0.3 wt. % to about 0.6 wt. % of the original non-woody species.

In a preferable embodiment of the invention, the temperature of the impregnating step is from about 50 to about 80° C. and the duration of this step is from about 0.5 to about 4 hours, higher temperatures usually corresponding to shorter durations.

The chelating agent in step b) is preferably selected from diethylene triaminepenta-acetic acid and diethylene triaminepentamethylene phosphonic acid. The content of said chelating agent in said impregnating step is preferably from about 0.05 wt. % and about 0.4 wt. % of the original non-woody species.

Wheat straw is a preferred raw material because of its availability and abundance, but other cereal straws and possibly other straws are also suitable for the purpose of the invention. Hemp is another preferred material for the preparation of lignocellulosic pulp in accordance with the invention because it provides significant savings in comparison to woody raw materials.

The alkaline peroxide solution preferably contains sodium carbonate or sodium hydroxide as the alkali. Both compounds can be used in combination as well. In an embodiment of the invention the non-woody species in step b) are further impregnated with ozone or peroxy acids (or peracids). The alkaline peroxide solution, the ozone, and he peracetic acid are added separately or sequentially to the non-woody species.

The conditions of the process of the invention may require some routine adjustment depending on the desired properties of the product, a non-wood pulp.

In accordance with the invention there is provided a process for preparing lignocellulosic pulp from non-woody species, the process comprising the steps of: pretreating the non-woody species with an aqueous acidic solution at a pH of about 1 to about 7, at a temperature below about 80° C. for a time effective to render said non-woody species susceptible to subsequent bleaching with a loss of weight of said non-woody species below about 10 wt. %, the solution containing from 0 to about 1.5 wt. % of a chelating agent based on the dry weight of the non-woody species; impregnating the non-woody species with an alkaline peroxide solution containing a chelating agent in an amount from about 0 to about 0.5 wt. % based on the dry weight of the non-woody species, at a temperature and for a time effective to achieve a brightness of resulting product at least about 45% ISO, with a loss of weight of said product below about 25 wt. % based on an original weight of said non-woody species; and mechanically defibrating the impregnated non-woody species to produce pulp.

In accordance with the invention there is further provided A process for preparing lignocellulosic pulp from non-woody species, the process comprising the steps of: pretreating the non-woody species with an aqueous acidic solution at a pH of about 1 to about 7, at a temperature of about 50–80° C. for a time from about 0.5 hours to about 2 hours, the solution containing from 0 to about 1.5 wt. % of a chelating agent based on the dry weight of the non-woody species; impregnating the non-woody species with an alkaline peroxide solution containing a chelating agent in an amount from about 0 to about 0.5 wt. % based on the dry weight of the non-woody species at a temperature of about 50 to 80° C. for a period of time between about 0.5 hour and 4 hours; and mechanically defibrating the impregnated non-woody species to produce pulp.

BRIEF DESCRIPTION OF THE DRAWINGS

Exemplary embodiments of the invention will now be described in accordance with the drawings in which.

DETAILED DESCRIPTION OF THE INVENTION

Figure 1:
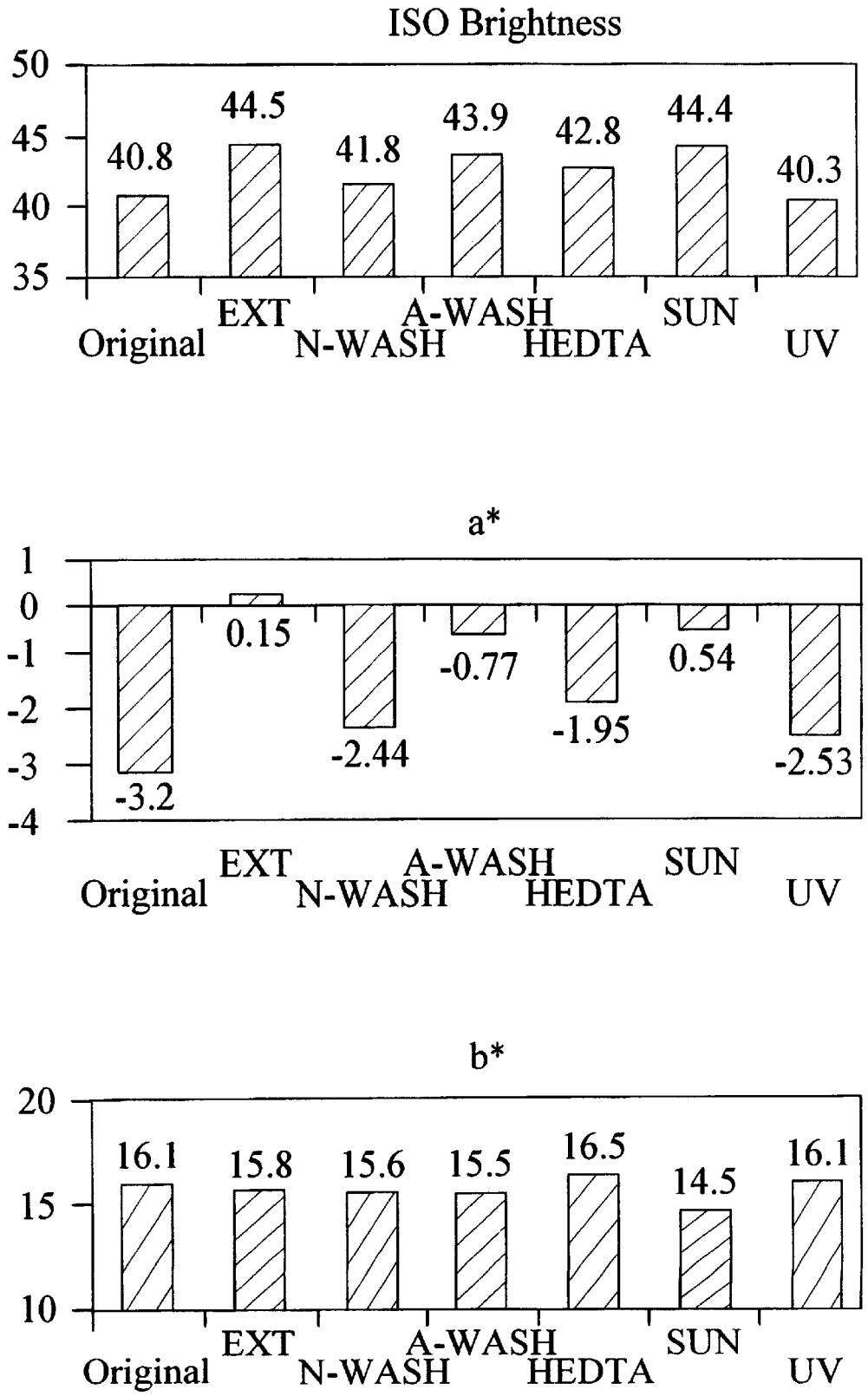
FIG. 1 shows the ISO brightness, the a* value, and the b* value for various treatments of the hemp for removal of the greenness.

The process in accordance with the present invention provides for the bleaching of non-woody species and the production of lignocellulosic pulp. The term non-woody species is hereinafter defined as hemp and straw.

Wheat straw is chemically and morphologically heterogeneous. Typically, the internodal material contains more cellulose and less ash and silica than other parts such as nodes and leaves, and thus the internodal material is a preferred fraction of the straw as a fibrous raw material for pulping and papermaking. Moreover, the internodal fraction has a lower metal content, especially of deleterious metals, manganese and iron.

Compared to other cereal straws, wheat straw is somewhat more suitable for pulping and papermaking because of its superior chemical and morphological character. Wheat straw is also a preferred raw material because of its abundance as an agricultural residue.

The non-woody species are cut and screened prior to being treated in accordance with the process of the present invention. Wheat straw is preferably chopped in a hammermill or another suitable machine to a length of between about half-inch and about one inch (13 to 25 mm). The cutting step serves not only to increase the surface area of the material and to facilitate subsequent treatment with chelant and an alkaline peroxide, but also to upgrade the quality of the fibrous raw material. The cutting process tends to produce a certain quantity of undesirable fines i.e. very short pieces of hemp, straw and straw dust. It is preferable to eliminate or reduce the amount of fines so formed by screening before the chopped non-woody species are subjected to subsequent treatment. It is believed that the fines, which are not suitable to be refined into useful fibers for the manufacturing of paper, consume needlessly the chemicals and reduce pulp drainage. Therefore, cutting and screening the non-woody species tends to yield brighter pulp at a lower peroxide consumption. Such an enhancement of bleaching efficiency can partially be explained by the finding that the process of chopping followed by screening increases the proportion of the internodal fraction in the cut straw and reduces the amount of iron and manganese.

The process of cutting and screening allows the separation of hemp into bast and core fractions. Obviously there are two options: one using the whole material for pulping and another one using these two fractions, respectively, for pulping. Technically, it is easier to process the two types of fibers separately because they are different chemically and morphologically.

Prior to alkaline peroxide impregnation, the non-woody species, preferably comminuted, are washed with hot water or, preferably, with an acidic aqueous solution. This pretreatment step offers certain benefits including a substantial increase of brightness and a remarkable decrease in peroxide consumption during the subsequent impregnation step. The pretreatment not only softens the non-woody species thereby improving their accessibility to bleaching chemicals, but also solubilizes water-soluble inorganic salts and deactivates biological or enzymatic hydrogen peroxide decomposition catalysts such as catalase.

It is preferable that the washing solution contain a chelating agent such as DTPA, (2-hydroxyethyl) ethylenediaminetriacetic acid (HEDTA), nitrilotriacetic acid (NTA), sodium tripolyphosphate (STPP), and other compounds known in the art for chelating functionality. Inclusion of one of the above-mentioned chelating agents helps in removing deleterious metals such as manganese and iron within the entire pH range used herein, improves brightness and reduces peroxide usage. While the content of the chelating agent may vary from 0 to about 1.5 wt. %, it should preferably be in the range of 0.3 to 0.6 wt. % based on the dry weight of the original non-woody species. The pH should be between about 1 and about 7, preferably between about 2 and about 3 Adjustments to the solution pH can be made with any organic or inorganic acid. The temperature of the pretreatment is preferably between 50 and 80° C. The duration of the pretreatment/wash step is between 0.5 and about 2 hours, preferably about 1 hour. The liquor-to-straw or hemp should provide sufficient liquor to saturate the straw or hemp, preferably at a ratio between 15 and 25 liters per kilogram. The non-woody species are separated from the acidic solution by filtration and washed with water several times to remove dissolved substances from the non-woody species.

Table I compares the dissolution of wheat straw components at three different pH values. It will be seen that pretreating the straw with low pH solutions, for example pH 3 or less, is particularly effective in lowering the manganese and iron content and improving the peroxide bleaching efficiency, while reducing the weight loss of the straw.

TABLE I

Chemical Composition of Wheat Straw pretreated at 60° C. for 1 hour.

| Sample Straw Recovery | Original | pH 7 | pH 5 | pH 3 |
|---|---|---|---|---|
| Yield, % | 100 | 93.0 | 94.0 | 94.7 |
| Klasson Lignin, % | 17.4 | 17.6 | | 17.3 |
| Acid Soluble Lignin, % | 1.9 | 1.6 | | 1.7 |
| Ash, % | 6.5 | 4.5 | | 4.9 |
| Toluene-ethanol Extractives, % | 3.4 | 1.6 | | 2.1 |
| Manganese, ppm | 5.9 | 4.4 | 3.7 | 1.5 |
| Iron, ppm | 31.7 | | 25.1 | 20.3 |

The pretreated non-woody species from the preceding step are impregnated with an aqueous alkaline peroxide solution that optionally contains a chelating agent as a peroxide stabilizer, preferably, but not exclusively, DTPMPA. Another acceptable chelating agent is diethylene triaminepenta-acetic acid. The presence of metal impurities in the bleaching chemicals and process water further justifies the use of a small amount of a chelating agent to further stabilize the peroxide and improve the bleaching. The DTPMPA content is preferably about 0.1 to 0.2% based on the dry weight of the original non-woody species. Generally, the chelating agent should be at a concentration between about 0.05 and 0.4 wt. % based on the dry weight of the original non-woody species. The total volume of the alkaline peroxide solution should generally not exceed 6 liter per kilogram of the dry straw or hemp substrate. Mixing is provided during the impregnation.

Some variables of the impregnation step are described below.

a) Peroxide Charge and Alkalinity.

The addition levels of peroxide are between 2% and 10% based on the dry weight of the original non-woody species. For a given peroxide charge, sufficient alkali is needed to adjust a proper ratio of alkali to peroxide which is required to provide an adequate concentration of hydroxyperoxide anion, the active bleaching agent, in the bleaching system. The total alkali, taken as NaOH, is added to give addition levels of between 1% and 8% of the dry weight of the original non-woody species. The varying concentrations of both peroxide and alkali and the type of alkali give a broad pH range of the initial solution between 10.2 and 12.0. The pH decreases quickly during the bleaching as hydroxide ions are consumed in neutralizing acidic, mostly carboxylic, substances originally present in wheat straw or hemp and created by oxidative reactions during bleaching. At the end of the impregnation step, the pH will usually range from 7.5 to 11.0. As a general rule, the higher the charge of peroxide and alkali, the higher pulp brightness and the lower pulp yield. Some routine skill is needed to select appropriate conditions to balance brightness gain and yield loss.

b) Alkali Source.

Both sodium hydroxide and sodium carbonate can be the alkali reagent in the alkaline peroxide bleach liquor. In general, sodium hydroxide is more effective than sodium carbonate in brightness development. On the other hand, for the same peroxide charge and active alkali equivalence, sodium carbonate has advantages including low cost, high pulp yield and low peroxide consumption. The sodium carbonate and hydrogen peroxide impregnation results in a lower degree of dissolution of lignin and hemicelluloses, thereby giving a smaller amount of organic substances in the spent bleaching liquor (lower COD discharge). These advantages of using sodium carbonate are more evident when the impregnation is performed at relatively low peroxide addition levels, e.g. about 4% of the straw weight. In these cases, the attainable pulp brightness is close to that using sodium hydroxide while using less peroxide.

c) Temperature and Time.

Under many bleaching conditions, temperature and time influences are interchangeable. An increase in temperature can compensate for a reduction in time and vice versa. The temperature of the impregnation can vary broadly, but should preferably be within about 50 to 80° C. The temperature variations within this range have only a marginal effect on the brightness response, but the higher the temperature, the higher the peroxide consumption. For the above temperature range, the retention time is preferably between ½ hour and 4 hours. The bleaching is a rapid reaction such that most of both brightness development and peroxide consumption occur in the first half-hour of retention time. During this period, the pH drops significantly to such a low level that the residual peroxide becomes ineffective as a brightening agent. In general, the most preferred impregnation uses a temperature of about 60° C. and a retention time of between ½ hour and 1 hour.

Depending on the addition levels of peroxide and alkali, the pulp yield ranges from 75% to 90% of the dry weight of the original straw, and the pulp brightness is between 48 and 64 percent ISO or the brightness gain is between 12 and 28 ISO points.

Upon completion of the alkaline peroxide impregnation, the non-woody species are mechanically defibrated (refined) in a suitable defibration apparatus in one or more stages to desired pulp properties including freeness. Preferably, refining is performed at atmospheric pressure to reduce brightness loss and peroxide consumption. During refining, the pulp is allowed to continue bleaching so that the amount of peroxide used in the impregnation step is preferably selected to result in some residual peroxide remaining after impregnation in order to maintain high brightness. The refined pulp is concentrated, e.g. by compressing and thickening, to remove residual impregnation solution containing potentially recyclable alkaline peroxide, then diluted with water, acidified to a pH of about 5.5, and then washed with water. The washed pulp is preferably screened to result in a pulp suitable for the production of paper products.

In accordance with an embodiment of the invention a process for bleaching hemp fibers to high levels of brightness comprises firstly the pretreatment of the fibers with an aqueous acidic solution and secondly the bleaching of the fibers with hydrogen peroxide, peracetic acid, or ozone. The first step is necessary to enhance the bleaching efficiency and is preferably performed at pH 3 or below. The bleaching chemicals of the second step are either applied separately or they are combined sequentially.

Hemp has two characteristically different fibrous parts: bast fibers and woody core fibers. The woody core fibers are relatively bright and chemically and morphologically similar to hardwoods such as aspen. However, the bast fibers are greenish and more difficult to bleach out. In accordance with an embodiment of the present invention the center of the process is that the fibers should be pretreated prior to bleaching with hydrogen peroxide, peroxy acids (or peracids) or ozone.

The original bast hemp is greenish. The degree of greenness is reflected by the value of a* of brightness pads. The value of a* is used to assess the effectiveness in greenness removal by various treatments and represents green-red, wherein green<0 and red>0. This means that the closer the value of a* is to zero the less greenish is the hemp. The green color of hemp is attributed to the presence of chlorophyls. Turning now to FIG. 1 the ISO brightness, the a* value and the b* value for various treatments of the hemp for removal of the greenness are shown. The following abbreviations are used to indicate the following treatment methods:

EXT: acetone soxhlet extraction for 8 hours

N-WASH: water washing at neutral pH

A-WASH: water washing at pH 2

HEDTA: chelation with 0.5% HEDTA

SUN: sunlight exposure for 2 weeks

UV: UV irradiation in a photo-reactor for 24 hours

As is seen from FIG. 1, the green color of the hemp is readily extractable by acetone as indicated by the a* value being 0.15, i.e. an a* value near zero. The acetone extraction, acid wash, and sunlight exposure are all shown to be effective in brightening the hemp and removing the greenish color as indicated by their a* values being close to zero. Among those treatment methods, the acid wash can be practiced on an industrial scale. The acid wash also provides further advantages and benefits with respect to the following peroxide bleaching step and is discussed below.

Figure 2:
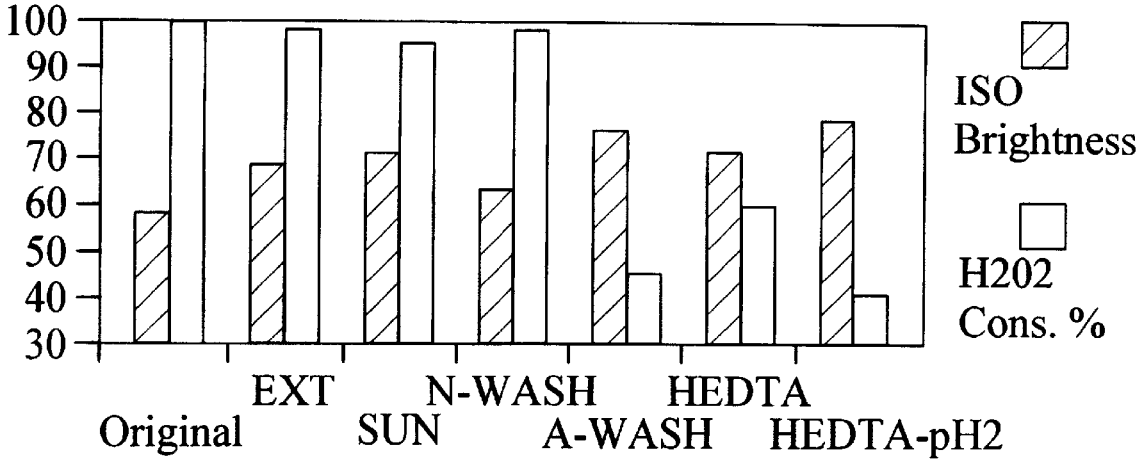
FIG. 2 shows a diagram of the achieved ISO brightness in relation to consumed hydrogen peroxide in the bleaching step for a plurality of pretreatment methods and their respective a* values.
Figure 2:
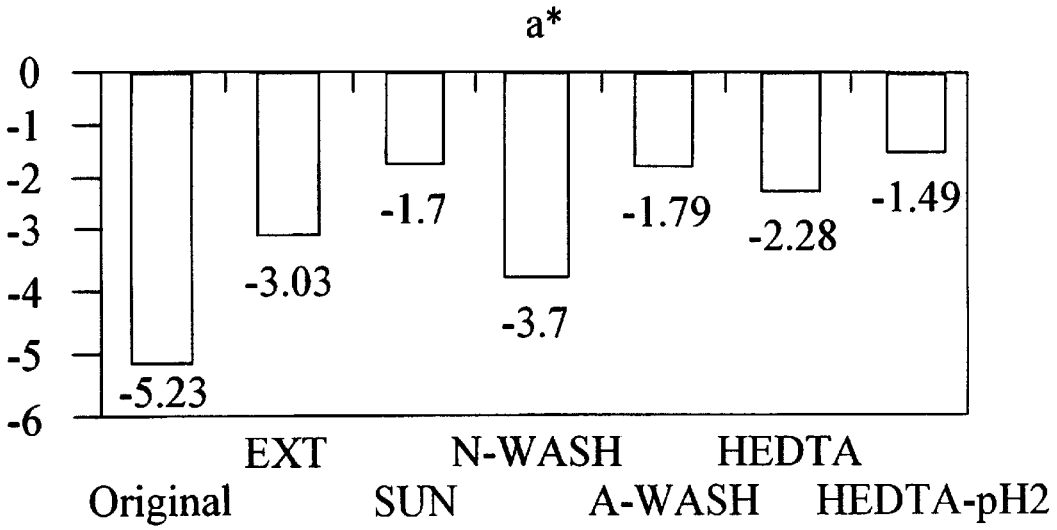

FIG. 2 presents a diagram of the achieved ISO brightness in relation to consumed hydrogen peroxide for a plurality of treatment methods. The diagram at the bottom of FIG. 2 shows the respective a* values for the plurality of treatment methods. It is seen from FIG. 2 that alkaline peroxide is ineffective in bleaching out the greenish color of the hemp. Further, the untreated hemp is not efficiently bleached by the hydrogen peroxide. It is observed that the hydrogen peroxide decomposes fast and hence much of the added hydrogen peroxide is actually wasted. Although the acetone extraction and the sunlight irradiation are effective in removing the greenness of hemp and moderate brightness levels are achieved through the hydrogen peroxide bleaching, the hydrogen peroxide consumption is almost 100%, i.e. it is very high. This result indicates that these pretreatment steps are not eliminating substances which catalyze the decomposition of hydrogen peroxide. Nevertheless, acid wash not only enhances the achieved ISO brightness levels but also reduces the hydrogen peroxide consumption to a significant extent. Moreover, the addition of 0.5 wt. % HEDTA further increases the achieved ISO brightness level by approximately 3 ISO units in comparison to acid wash alone as shown in FIG. 2. This is further indicated by the a* value for the acid wash and the acid wash with added HEDTA which changes from −1.79 to −1.49, respectively.

Figure 3:
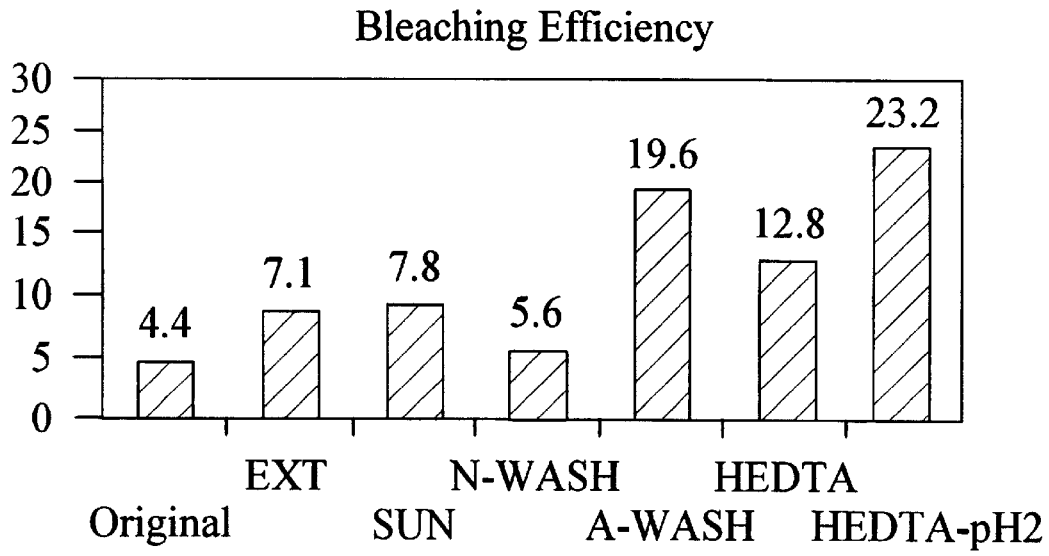
FIG. 3 shows a diagram comparing the bleaching efficiency achieved with the plurality of pretreatment methods.

FIG. 3 shows a diagram comparing the bleaching efficiency achieved with the different pretreatment methods. The acid wash in the absence or presence of HEDTA affords a bleaching efficiency of approximately 4 to 5 times higher than that of the untreated hemp and approximately 3.5 to 4 times higher than that of the hot water washed hemp (N-WASH).

Figure 4:
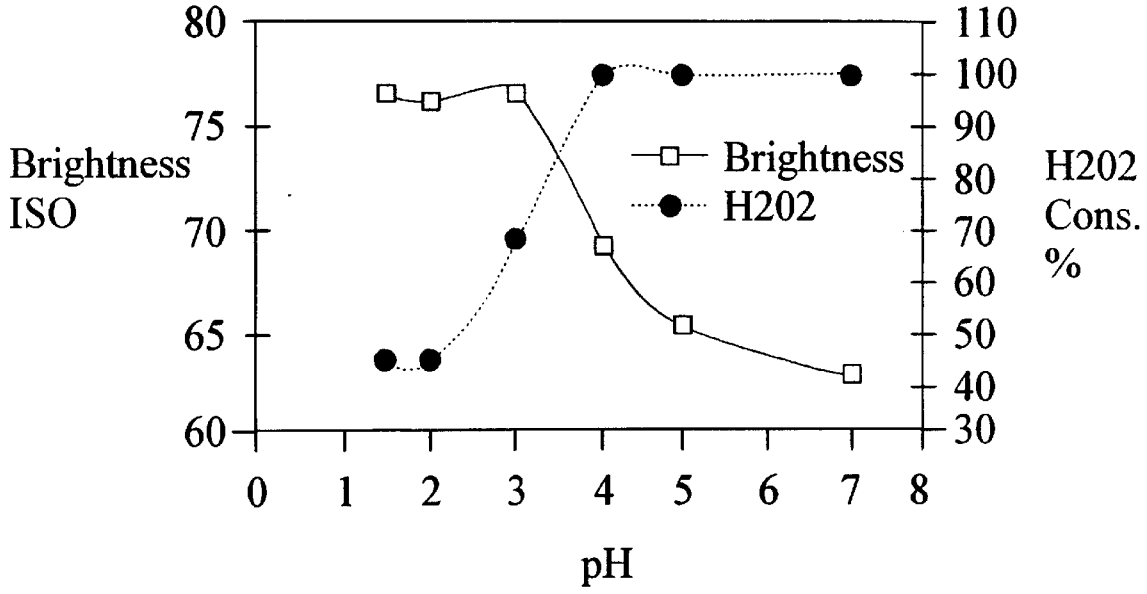
FIG. 4 shows a graph of ISO brightness and hydrogen peroxide consumption vs. the pH of the acid wash.

FIG. 4 shows a graph of ISO brightness and hydrogen peroxide consumption vs. the pH of the acid wash. As can be seen from the graph presented in FIG. 4 the pH value of the acid wash is a key factor in influencing the peroxide bleaching. The pH has to reach a point so that the pretreatment is capable of solubilizing detrimental substances present in hemp which consume peroxide and/or catalyze peroxide decomposition. FIG. 4 shows that the variation of the pH value in the range between 3 and 1.5 does not result in any substantial difference in the brightness development.

Table II shows the metal content of hemp before and after various treatments as indicated in Table II. The values are given in ppm.

TABLE II

Metal Content of Hemp after Various Treatments

| Sample | Al | Ca | Co | Cr | Cu | Fe | Mg | Mn | Ni | Si | Zn |
|---|---|---|---|---|---|---|---|---|---|---|---|
| Hemp | 39.8 | 5132 | 0.8 | 0.8 | 1.6 | 71.7 | 878 | 11.2 | 0.8 | 184 | 26 |
| pH 7 Wash | 14.8 | 4263 | 0.8 | 0.8 | 0.8 | 56.2 | 635 | 10.9 | 0.8 | 136 | 17.2 |
| pH 4 Wash | 11.6 | 3700 | 0.8 | 0.8 | 3.1 | 48.5 | 395 | 8.5 | 0.8 | 129 | 15.4 |
| pH 2 Wash | 9.6 | 158 | 0.8 | 0.8 | 0.8 | 31.3 | 16.5 | <0.8 | 0.8 | 103 | 8.7 |
| HEDTA | 5.9 | 3741 | 0.7 | 0.7 | <0.7 | 28.9 | 599 | 0.7 | <0.7 | 113 | 8.1 |

Table II clearly demonstrates the effect of the acid wash, i.e. the lower the pH value of the acid wash the higher the removal of the alkali-earth metals Ca and Mg. At pH 2 most of the alkali-earth metals are removed. The acid wash at pH 2 is more effective in removing magnesium from hemp than is the chelation with HEDTA. The removal of magnesium results in the destruction of chlorophyls. Thus, acid wash at pH 2 is more effective in removing the green color from hemp than HEDTA chelation. This is also shown in FIG. 1.

Transition metals, such as manganese, iron, or copper, generally act as peroxide decomposition catalysts. However, the acid wash at pH 2 and the chelation with HEDTA do not significant alter the contents of Mn, Fe, or Cu in the hemp. Hence, mechanisms by which the acid wash enhances the peroxide bleaching are more effective than the metal dissolution. It is likely that at a low pH value hemp materials are solubilized in addition to the metals. Those materials including biologically active materials, such as enzymes and fungi, consume peroxide and/or catalyze peroxide decomposition.

Figure 5:
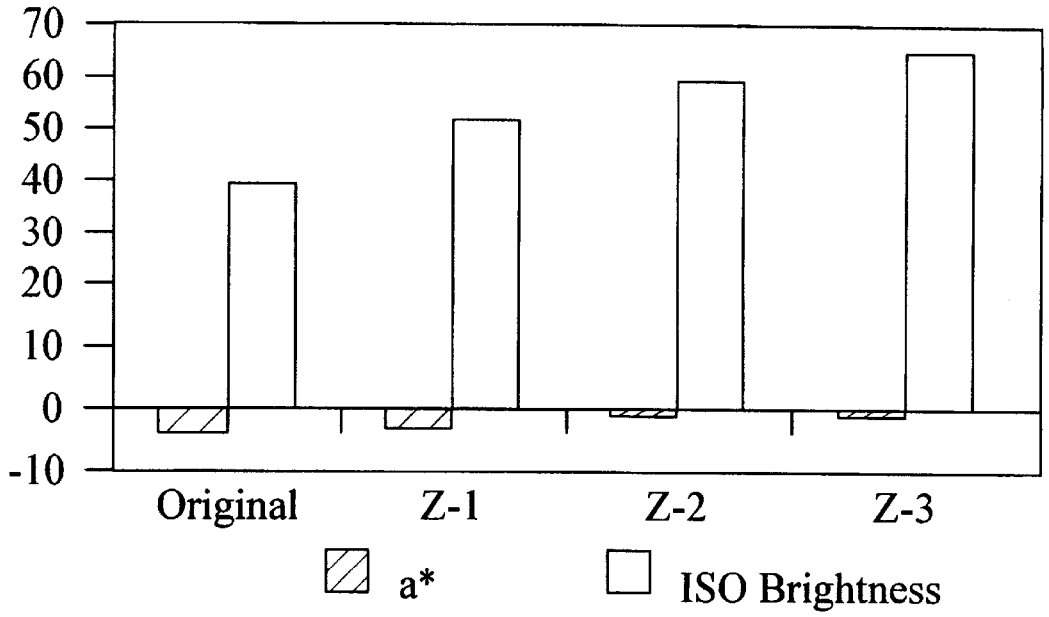
FIG. 5 shows a bar graph of the ISO brightness and the a* value for removing the green color from hemp at varying pH values and ozone consumption.

FIG. 5 shows a bar graph of the ISO brightness and the a* value for removing the green color from hemp at varying pH values and ozone consumption in which the following notations are used:

$Z_1$: original hemp, neutral pH, 2.1% ozone consumed $Z_2$: acid-washed hemp, pH 2, 0.65% ozone consumed $Z_3$: acid-washed hemp, pH 2, 1.24%ozone consumed FIG. 5 shows that the ozonation alone is not effective in removing the greenness from hemp. Although more ozone is consumed, untreated hemp is not efficiently bleached by ozone. If the hemp is untreated much of the applied ozone is consumed by certain substances which are removable by the acid wash. FIG. 5 shows clearly that the ozonation achieves better bleaching results with the acid washed hemp.

Figure 6:
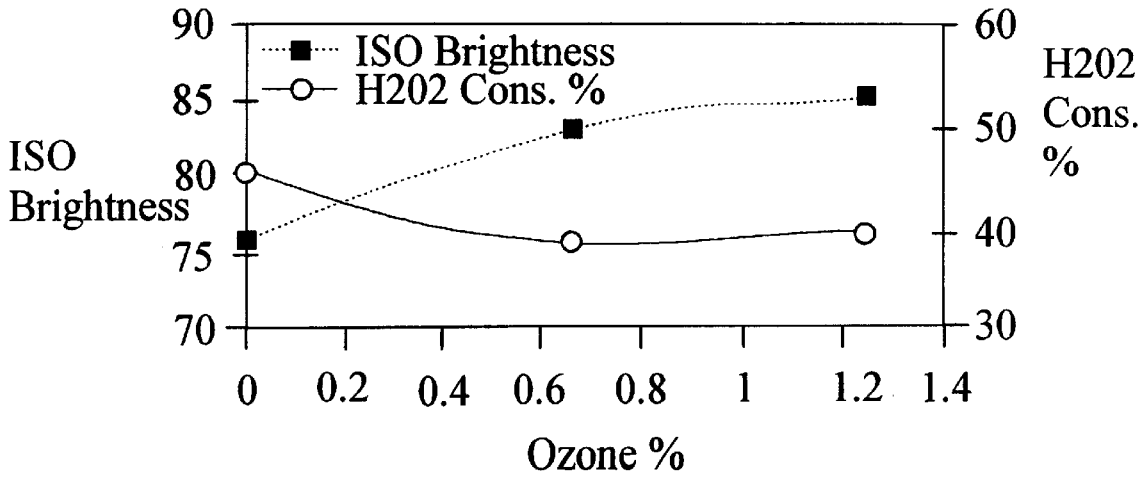
FIG. 6 presents a graph showing the effect of ozone charge on the efficiency of subsequent peroxide bleaching correlating ISO brightness, ozone %, and $H_2O_2$ comsumption %.

Table III below demonstrates that the acid wash-ozonation-peroxide bleaching is an advantageous sequence to bleach hemp to a high brightness. In a preferred embodiment in accordance with the invention ozonation is performed at an acidic pH and hence fits well into the bleaching process in accordance to the present invention including acid wash pretreatment and peroxide bleaching. The ozone charge has an effect on the efficiency of the subsequent peroxide bleaching. The addition of ozonation between the acid wash and peroxide bleaching increases the final brightness of peroxide-bleached hemp. This is shown in FIG. 6 correlating ISO brightness, ozone %, and $H_2O_2$ comsumption %.

TABLE III

Results of Ozone-Peroxide Bleaching Sequence

| | $Z_1P$ (2.1% ozone/ 2.0% $H_2O_2$) | $Z_2P$ (0.65% ozone/ 1.5% $H_2O_2$) | $Z_3P$ (1.24% ozone/ 1.6% $H_2O_2$) |
|---|---|---|---|
| ISO Brightness | 70.6 | 83.2 | 84.5 |
| a* | −2.40 | −1.00 | −0.72 |
| b* | 9.35 | 4.78 | 3.98 |

Figure 7:
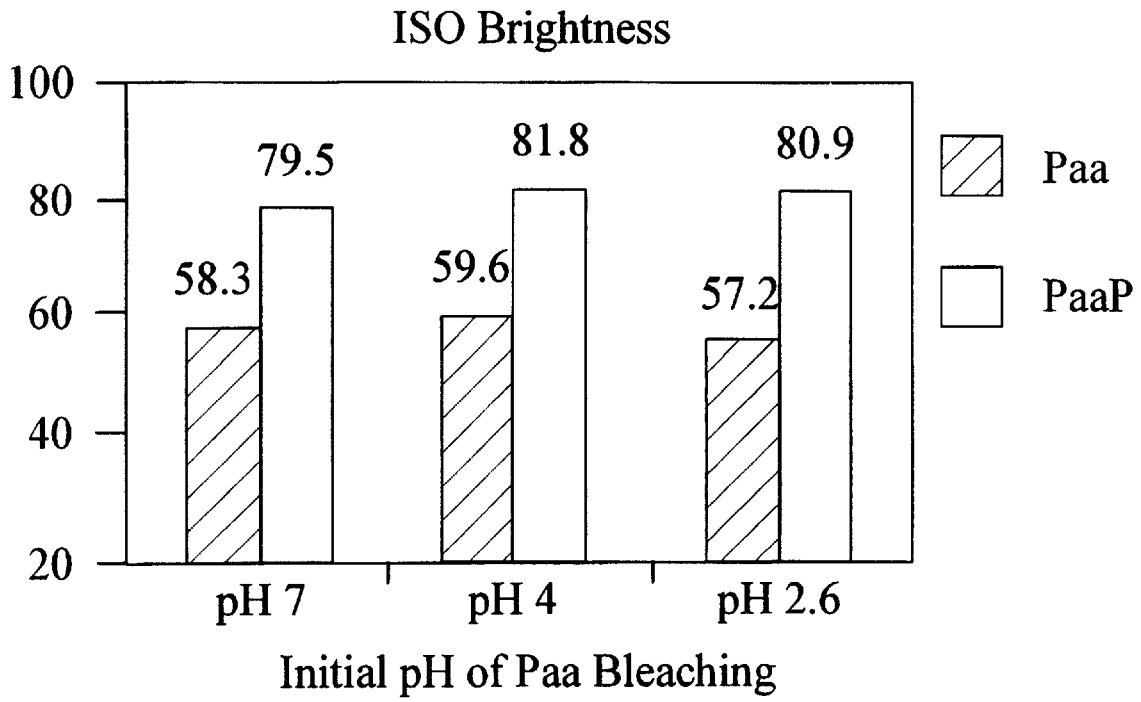
FIG. 7 shows a bar graph comparing the achieved ISO brightness at three different pH values for hemp bleached with peracetic acid (Paa) and hemp bleached with PaaP, a bleaching sequence using peracetic acid then peroxide.

FIG. 7 shows a bar graph comparing the achieved ISO brightness at three different pH values for hemp bleached with peroxy acids (or peracids) acid. PaaP is a bleaching sequence using peracetic acid then peroxide. This figure shows that peracetic acid alone brightens the hemp and also enhances the final brightness when it is combined with peroxide.

Table IV shows the yield in wt % of hemp pulp by various treatments. For all types of treatments the weight loss is below 25%.

TABLE IV

Yield of Hemp Pulp by Various Treatments

| Treatment | Yield [%] |
|---|---|
| A | 92.1 |
| P | 89.2 |
| A-P | 85.2 |
| $Z_{2.1\%}$-P | 84.8 |
| A-$Z_{0.65\%}$-P | 79.4 |
| A-$Z_{1.24\%}$-P | 79.4 |
| A-$Paa_{pH2.6}$-P | 84.3 |
| A-$Paa_{pH7}$-P | 83.9 |

A: Acid Wash
P: Peroxide Bleaching
Z: Ozonation
Paa: Peracetic Acid

It is demonstrated above that hemp is bleached to high levels of brightness at reasonable bleaching chemical usage. In this bleaching process, the acid wash, pretreatment stage, is critical in achieving a high brightness and a high bleaching efficiency. The highest final brightness is attained by optimizing the bleaching conditions or the combinations of bleaching chemicals.

EXAMPLES

The following non-limiting examples illustrate the invention in more detail:

Example 1

Benefits of Acid Wash

Approximately 10 g (dry weight) of chopped wheat straw was soaked in about 200 ml of water in a polyethylene bag. The solution pH was then adjusted to 5 using acetic acid or to 3 or 2 using sulfuric acid and the bag was immersed in a water bath of 60° C. with frequent mixing for one hour. The washed straw was subsequently transferred into another polyethylene bag into which was added an alkaline peroxide solution containing 4% NaOH, 4% $H_2O_2$ and 0.1% DTPMPA (all based on the dry weight of the original straw). The total volume of the solution was about 60 ml. After a thorough mixing by squeezing and kneading, the solution pH was measured and the bag was immersed in a water bath of 70° C. with occasional mixing for 2 hours. Upon completion of impregnation, the straw was squeezed to obtain sufficient amounts of solution for pH and residual peroxide measurements, and then was defibrated in a waring blender. The resulting pulp was acidified to about pH 5.5 and washed. ISO brightness and pulp yield were determined.

Table V illustrates the effect of acid wash pretreatment on the subsequent results. Sample 1 corresponds to untreated straw. For sample 2, the acid wash pretreatment step was omitted and the sample was treated directly with the impregnation solution. Samples 3–5 were treated at various pH. A comparison of samples 2, 3, 4 and 5 of Table V demonstrates that the acid wash was effective in increasing the brightness and in lowering the peroxide consumption. The best results were obtained at a pH of about 2.

TABLE V

Effect of Acid Wash Pretreatment on the Properties of Straw Pulp

| Sample | Solution pH | Brightness ISO % | $H_2O_2$ Consumed %[a] |
|---|---|---|---|
| 1 (original straw) | | 36.5 | |
| 2 (no wash) | | 46.9 | 3.9 |
| 3 | 5 | 48.5 | 3.7 |
| 4 | 3 | 50.8 | 2.8 |
| 5 | 2 | 53.2 | 2.2 |

[a]based on the dry weight of original straw.

Example 2

Effect of Chelating Agents in the Acid Wash

Runs 3, 4 and 5 were repeated as in Example 1 except for the addition of chelating agents as listed in Table VI, to the acid wash solutions. In comparison with the data of Table V, the addition of chelating agent in the pretreatment, in general, results in a greater degree of brightness gain and peroxide saving.

TABLE VI

| Sample | Chelating Agent | Solution pH | Brightness ISO % | $H_2O_2$ consumed %[a] |
|---|---|---|---|---|
| 6 | HEDTA | 5 | 51.0 | 3.4 |
| 7 | HEDTA | 3 | 52.3 | 2.5 |
| 8 | HEDTA | 2 | 53.8 | 2.0 |
| 9 | DTPA | 5 | 49.6 | 3.5 |
| 10 | DTPA | 3 | 51.3 | 2.7 |
| 11 | STPP | 5 | 48.3 | 3.6 |
| 12 | STPP | 3 | 52.0 | 2.8 |

[a]based on dry weight of original straw

Example 3

Comparison of Sodium Carbonate and Sodium Hydroxide

As shown in Table VII, for samples 13, 14, 15, 16 and 17 the straw was pretreated with 0.5% DTPA at pH 4.5 and 70° C. for 1 hour, and then the impregnation step was performed at 70° C. for 2 hours. Samples 18–22 of Table VII employed wheat straw identical as in sample 7 of Table VI and an impregnation temperature of 60° C. was used. The make-up of the impregnating solution is given in Table VII. Assuming an equivalence of 1.3 g of sodium carbonate to 1 g of sodium hydroxide in terms of active alkali, there is a comparable addition level of active alkali for a series of samples, i.e. about 4% (as NaOH) for samples 13–19 and about 6% (as NaOH) for samples 20–22. Generally, the acceptable amount of the alkali is from about 1% to about 8% by weight (calculated as NaOH) of the dry weight of original straw.

Table VII shows that the advantages of using sodium carbonate include enhancement of bleaching efficiency, i.e. units of brightness gain per peroxide consumed, and increase of pulp yield. The benefits of sodium carbonate replacements for sodium hydroxide are particularly evident when the impregnation uses relatively low peroxide charges, e.g. about 4%. Comparing sample 17 with sample 13, and sample 19 with sample 18, the pulp brightness is only less than 1 ISO point lower, but the peroxide consumption is much lower and the pulp yield is higher. However, when the straw is impregnated with 6% $H_2O_2$ (samples 20–22), sodium carbonate is less effective in brightness development.

TABLE VII

| | DTPA-Chelated Straw | | | | | HEDTA-Chelated Straw | | | | |
|---|---|---|---|---|---|---|---|---|---|---|
| Sample | 13 | 14 | 15 | 16 | 17 | 18 | 19 | 20 | 21 | 22 |
| Solution make-up | | | | | | | | | | |
| $H_2O_2$ % | 4.0 | 4.0 | 4.0 | 4.0 | 4.0 | 4.0 | 4.0 | 6.0 | 6.0 | 6.0 |
| NaOH % | 4.0 | 3.0 | 2.0 | 1.0 | 0 | 4.0 | 0 | 6.0 | 0 | 4.0 |
| $Na_2CO_3$ % | 0 | 1.3 | 2.6 | 4.0 | 5.3 | 0 | 5.2 | 0 | 8.0 | 2.7 |
| $Na_2SiO_3$ % | 3.0 | 3.0 | 3.0 | 3.0 | 3.0 | | | | | |
| $MgSO_4$ % | 0.05 | 0.05 | 0.05 | 0.05 | 0.05 | | | | | |
| DTPMPA % | | | | | | 0.1 | 0.1 | 0.1 | 0.1 | 0.1 |
| ISO % | 54.0 | 54.5 | 52.7 | 53.5 | 53.2 | 54.3 | 53.9 | 58.3 | 54.4 | 55.5 |
| Yield % | 86.5 | 87.2 | 89.8 | 89.2 | 90.6 | 86.8 | 90.5 | 85.8 | 87.7 | 85.1 |
| $H_2O_2$ cons. %[a] | 3.2 | 3.0 | 2.9 | 2.7 | 2.6 | 2.4 | 1.7 | 4.1 | 2.7 | 3.6 |

[a]based on the dry weight of original straw

Example 4

Effect of Sodium Silicate

Samples 23, 24, and 25 of Table VIII were obtained by repeating sample 13 of Table VII with varying amounts of sodium silicate (420 Baume). For samples 26, 27, 28 and 29 (Table VIII) the straw was pretreated according to sample 7 (Table VI) and impregnated for 2 hours at 60°. Overall, the addition of silicate increased the brightness by about 1 ISO point and slightly increased the peroxide consumption (sample 23 vs. samples 24 and 25, sample 26 vs. sample 27). However, this magnitude of brightness increment can be achieved by using 0.2% DTPMPA (sample 28) or 0.2% DTPA (sample 29). As the commercial sodium silicate contains about 11.5% of caustic alkali, the silicate used herein functions more likely as an additional alkali source and is thus superfluous.

Example 5

Effect of Magnesium Sulfate

Samples 30, 31 and 32 (Table IX) were prepared using the same procedure as sample 23 (Table VIII) except for the addition levels of magnesium sulfate. For samples 33 and 34, the wheat straw was chelated with 0.5% HEDTA at pH 5 and 60° C. for 1 hour and impregnated at 70° C. for 2 hours. Sample 35 resulted from repeating sample 26 (Table VIII) with the addition of 0.2% magnesium sulfate. The latter is used to minimize peroxide decomposition in wood bleaching. In the wheat straw process, the adverse effect was found. The addition of magnesium sulfate actually lowered the pulp brightness (compare sample 30 vs. samples 31 and 32, sample 33 vs sample 34, and sample 35 vs. sample 26 of Table VIII). This clearly suggests that it is not necessary to include magnesium sulfate in an alkaline peroxide bleach liquor for wheat straw (and probably for other straws as well).

TABLE VIII

| | DTPA chelated straw | | | HEDTA chelated straw | | | |
|---|---|---|---|---|---|---|---|
| Sample | 23 | 24 | 25 | 26 | 27 | 28 | 29 |
| Solution make-up | | | | | | | |
| $H_2O_2$ % | 4.0 | 4.0 | 4.0 | 4.0 | 4.0 | 4.0 | 4.0 |
| NaOH % | 4.0 | 4.0 | 4.0 | 4.0 | 4.0 | 4.0 | 4.0 |
| $Na_2SiO_3$ % | 0 | 2.0 | 4.0 | | 3.0 | | |
| $MgSO_4$ % | 0.05 | 0.05 | 0.05 | | | | |
| DTPMPA % | | | | | | 0.2 | |
| DTPA % | | | | | | | 0.2 |
| ISO % | 52.8 | 53.6 | 53.9 | 53.7 | 55.0 | 55.7 | 55.0 |
| $H_2O_2$ cons. %[a] | 3.1 | 3.1 | 3.2 | 2.6 | 2.8 | 2.5 | 2.4 |

[a]based on the dry weight of original straw

Example 6

Comparison with Standard Alkaline Peroxide Bleaching

A control pulp was prepared using a standard alkaline peroxide bleach liquor make-up. Chopped straw was soaked in water at 60° C. for 1 hour. The impregnation condition was as follows: 4% $H_2O_2$, 4% NaOH, 2% $Na_2SiO_3$, 0.1% $MgSO_4$, and 0.2% DTPA (all based on the dry weight of the original straw), 70° C. and 2 hours. The resulting pulp brightness was 48.9 ISO % and the peroxide consumption was 3.5% of the dry weight of the original straw.

TABLE IX

| Sample | DTPA Chelated Straw | | | HEDTA-Chelated Straw | | |
|---|---|---|---|---|---|---|
| Solution make-up | 30 | 31 | 32 | 33 | 34 | 35 |
| $H_2O_2$ % | 4.0 | 4.0 | 4.0 | 4.0 | 4.0 | 4.0 |
| NaOH % | 4.0 | 4.0 | 4.0 | 4.0 | 4.0 | 4.0 |
| $MgSO_4$ % | 0 | 0.1 | 0.2 | 0 | 0.1 | 0.2 |
| ISO % | 53.1 | 52.3 | 52.4 | 49.7 | 48.0 | 52.7 |
| $H_2O_2$ cons. %[a] | 3.0 | 3.0 | 2.9 | 3.2 | 3.2 | 2.6 |

[a]based on the dry weight of the original straw

In general, the process according to the invention provides a more efficient bleaching than conventional alkaline peroxide bleaching. The process of the instant invention offers flexibility in choosing conditions with regard to the use of chelating agents and eliminates the need to add silicate and magnesium sulfate. In comparison with the control pulp, sample 5 (Table V) was 4.3 ISO points brighter and consumed 37% less peroxide while only using pH 2 acid wash in the pretreatment step and 0.1% DTPMPA in the alkaline peroxide impregnation. If a chelating agent, e.g. HEDTA, is used in the pretreatment, the pH can be raised to about 3 and a similar or greater degree of brightness increment can be achieved. Sample 26 (Table VIII) had a brightness of 4.8 ISO points higher without chelating agent in the impregnation stage. Sample 18 (Table VII) had a brightness of 5.4 ISO points higher with 0.1% DTPMPA in the impregnation stage. Sample 28 (Table VII) had a brightness of 5.8 ISO points higher with 0.2% DTPMPA in the impregnation stage. Sample 29 (Table VIII) had a brightness of 5.1 ISO points higher with 0.2% DTPA in the impregnation stage. For these samples, the peroxide saving was between 25% and 30%.

Example 7

Material and Method for the Bleaching of Hemp

Cut and screened hemp bast fibers containing <10% of the core fraction were employed for the preparation of lignocellulosic pulp.

For the acid wash or chelation step approximately 25 g (o.d.) of the cut and screened hemp were soaked in about 800 ml of water. The pH of the solution was then adjusted using sulfuric acid (10%). 0.5% HEDTA was added and the solution containing the hemp was heated to 60° C. for 1 hour.

The peroxide bleaching was carried out with approximately 20 g (o.d.) of hemp, 15% consistency implying a ratio of 15 g hemp-to-85 g water. The solution was heated to 60° C. for 2 hours and 4%$H_2O_2$, 3%NaOH, 3%$Na_2SiO_3$, 0.1%$MgSO_4$, 0.2%DTPMPA (or alternatively 0.2%DTPA) were added.

The ozonation was performed at room temperature and the substrate consistency was 35–40%.

The peracetic acid bleaching was carried out with a substrate having 20% consistency. The solution was heated to 60° C. for 2 hours and 2% peracetic acid were added. The pH of the solution was adjusted using a solution of $NaHCO_3$.

The brightness pads were prepared from untreated as well as treated hemp. The hemp was chopped in a Waring blender and the solution was then acidified to a pH value of approximately 5.

What is claimed is:

1. A process for preparing lignocellulosic pulp from non-woody species, the process comprising the step of:

(a) impregnating the non-woody species with an alkaline peroxide solution at a temperature and for a time effective to bleach the non-woody species, and (b) mechanically defibrating the impregnated non-woody species to produce pulp, wherein prior to step (a), pretreating the non-woody species with an aqueous acidic solution at a pH from about 2 to about 3, at a temperature and for a time effective to enhance peroxide bleaching efficiency in step (a).

2. A process according to claim 1 wherein said time effective to enhance peroxide bleaching efficiency in step (a) is from about 0.5 to about 2 hours.

3. A process according to claim 1 wherein the temperature in step (a) is below about 80° C.

4. A process according to claim 3 wherein said temperature in step (a) is between about 50° C. and about 80° C.

5. A process according to claim 1 wherein the aqueous acidic solution contains a chelating agent in an amount ranging between 0 to about 1.5 wt. % based on the dry weight of the non-woody species.

6. A process according to claim 5 wherein the amount of said chelating agent in pretreating step is from about 0.3 wt % to about 0.6 wt %.

7. A process according to claim 5 wherein said chelating agent in step (b) is one or more compounds selected from the group consisting of diethylene triaminepenta-acetic acid, hydroxyethylethylenediaminetriacetic acid, nitriloacetic acid, sodium tripolyphosphate and diethylenetriaminepentamethylene-phosphonic acid.

8. A process according to claim 1 wherein prior to said pretreating step the non-woody species are comminuted.

9. A process according to claim 8 wherein said non-woody species comprise at least one of wheat straw and hemp.

10. A process according to claim 9 wherein the non-woody species in step (a) are ether impregnated with at least one of ozone and or peracids.

11. A process according to claim 10 wherein the alkaline peroxide solution, the ozone and the peracid are added separately or sequentially to the non-woody species.

12. A process according to claim 1 wherein said acidic aqueous solution in said pretreating step contains at least one of acetic acid and sulfuric acid.

13. A process according to claim 1 wherein said alkaline peroxide solution contains at least one alkali selected from sodium carbonate and sodium hydroxide.

14. A process according to claim 13 wherein said alkali is present at a concentration between about 1 and 8 wt. % calculated as sodium hydroxide, of the dry weight of said non-woody species before step (b).

15. A process according to claim 13 wherein said alkaline peroxide solution contains hydrogen peroxide.

16. A process according to claim 15 wherein said hydrogen peroxide is present at a concentration between 2 and about 10 wt. % of the dry weight of said non-woody species before step (b).

17. A process according to claim 1 wherein the alkaline peroxide solution contains a chelating agent in an amount ranging between 0 to about 0.5 wt. % based on the dry weight of the non-woody species.

18. A process according to claim 17 wherein said chelating agent in step (a) is selected from diethylene triaminepenta-acetic acid and diethylene triaminepentamethylene phosphonic acid.

19. A process according to claim 17 wherein said chelating agent is present at a concentration between about 0.05 and 0.4 weight percent of the dry weight of said non-woody species before step (b).

20. A process according to claim 17 wherein occurs a loss of weight of the non woody species in step (b), the loss below about 10 wt. %.

21. A process according to claim 20 wherein a loss of weight of a resulting product in step (a) is below about 25 wt. % based on original weight of the non-woody species.

* * * * *

UNITED STATES PATENT AND TRADEMARK OFFICE

CERTIFICATE OF CORRECTION

PATENT NO. : 6,258,207 B1
DATED : July 10, 2001
INVENTOR(S) : Pan

It is certified that error appears in the above-identified patent and that said Letters Patent is hereby corrected as shown below:

Column 15,
Line 28, "420 Baume" should read -- 42° Baume --."

Column 18, claim 10,
Line 22, "ether" should read -- further --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*